US006467489B1

(12) United States Patent
Christiansen

(10) Patent No.: US 6,467,489 B1
(45) Date of Patent: Oct. 22, 2002

(54) CHEMILUMINESCENT ARTICLE

(75) Inventor: Gregory John Michael Christiansen, Paradise (AU)

(73) Assignee: Nova Glo International Ltd., Payneham (AU)

( * ) Notice: Subject to any disclaimer, the term of this patent is extended or adjusted under 35 U.S.C. 154(b) by 0 days.

(21) Appl. No.: 09/530,140

(22) PCT Filed: Oct. 28, 1998

(86) PCT No.: PCT/AU98/00900

§ 371 (c)(1),
(2), (4) Date: Apr. 18, 2000

(87) PCT Pub. No.: WO99/21453

PCT Pub. Date: May 6, 1999

(30) Foreign Application Priority Data

Oct. 28, 1997 (AU) ..... PP 0061

(51) Int. Cl.[7] ..... A45D 29/00; A45D 29/18

(52) U.S. Cl. ..... 132/73; 132/735

(58) Field of Search ..... 132/73, 73.5, 74.5, 132/75; 362/34, 159

(56) References Cited

FOREIGN PATENT DOCUMENTS

| | | | | |
|---|---|---|---|---|
| FR | 2493116 | * | 5/1982 | ..... 132/73 |
| JP | 55066985 | * | 5/1980 | ..... 132/73 |
| JP | 9266815 | * | 10/1997 | ..... 132/73 |

* cited by examiner

*Primary Examiner*—John J. Wilson
*Assistant Examiner*—Robyn Kieu Doan
(74) *Attorney, Agent, or Firm*—J. Harold Nissen; Lackenbach Siegel

(57) ABSTRACT

A finger nail cap having a casing of plastics material having a transparent upper side, a lower side shaped to fit onto a wearer's nail, and a cavity with a chemilunminescent chemical therebetween, and frangible means holding a catalyst in isolation in the cavity or a valve through one of the sides to allow for introduction of a catalyst to the chemical.

18 Claims, 5 Drawing Sheets

CHEMILUMINESCENT ARTICLE

Figure 1:
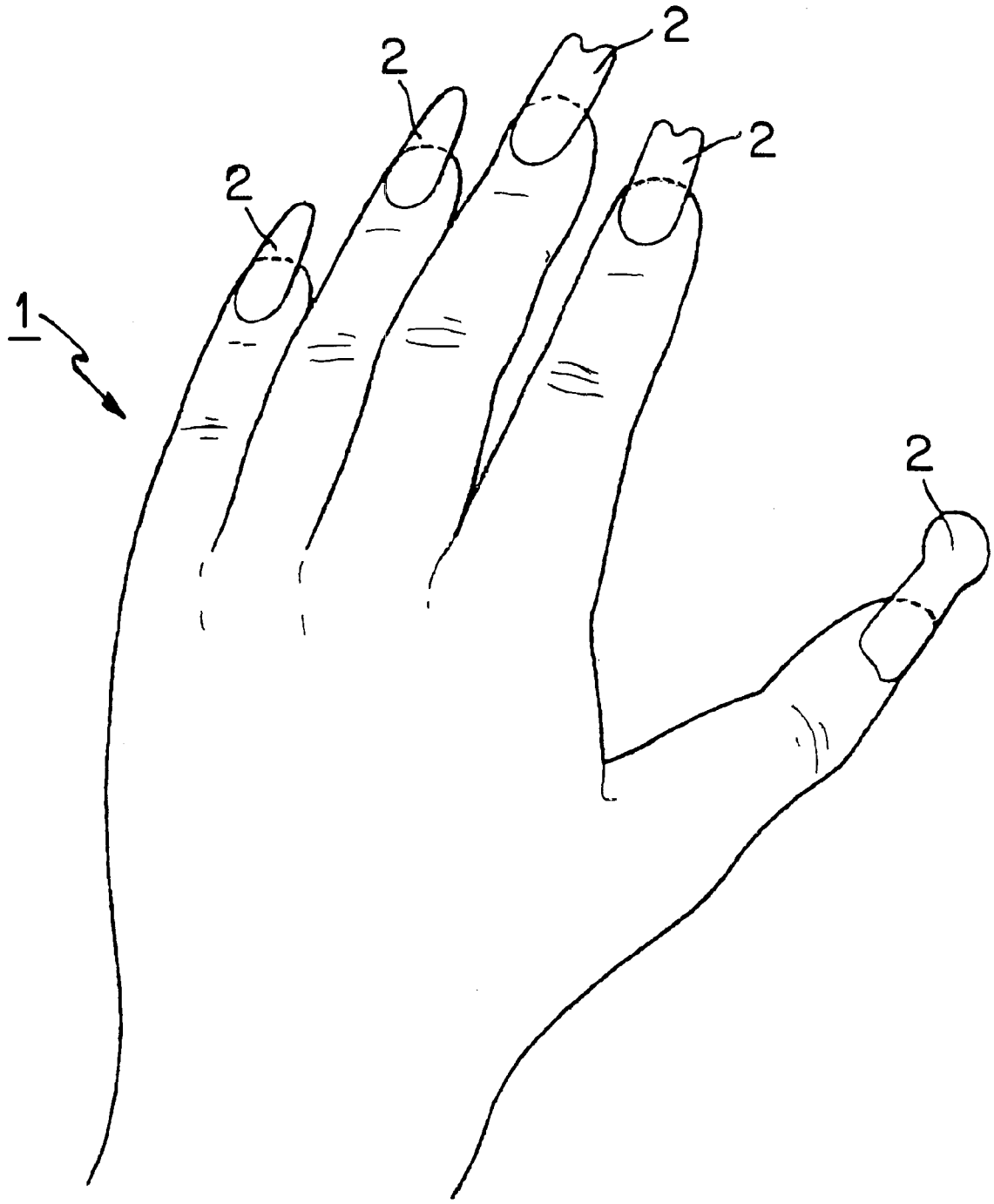

This invention relates to an improved novelty item being a nail cap that can be attached to a human body and provide advantageous decoration.

There is a continuing demand for items of decoration or entertainment which are different or are outlandish or otherwise excel so that people can enjoy and in many ways out do others by having or using such decoration.

The difficulty is to find items and locations for this purpose which can provide advantageous results accordingly.

The object of this invention then is to provide a decoration item which has significant advantage over those items that have been previously used or at least provide the public with a useful alternative.

In accord with this invention then there is provided a nail cap which can effect a luminescent transmission.

In preference, the nail cap has a casing defining a cavity with an upper wall which will transmit visible light therethrough, the cavity having within it a chemical to which can be added a catalyst to effect a luminescent effect.

In preference, the nail cap has a casing shaped so as to have an underneath part which is adapted to be adhered to the finger nail of a wearer.

In preference in accord with this invention however, there is provided a finger nail cap including a casing of plastics material having an upper side with an external convex shape and a lower side definingthere between a cavity, at least one chemical being within the cavity and being a chemical which when activated by a catalyst will effect chemilunminescent, the upper side of the casing at least being transparent or having a part that is transparent so that light from any chemilunminescent reaction within the cavity will shine there through, the lower side having a lowermost shape which is concave on its outer side and of a complementary shape and size to a nail of a intended wearer.

By having luminescent finger nail caps on each of the nails of a wearer with the caps having been activated so as to luminesce, the effect particularly in darkened surroundings such as in a Night club with lower lighting, can be quite spectacular and provide both a visually spectacular effect and one which provides to each wearer significant attraction.

I will now explain a number of specific details as to the variations that I currently envisage in terms of each of the caps that might be used and some of the techniques by which luminescence might be achieved within each of the caps.

The invention can apply both to the caps per se appropriate for this purpose and to the combination of caps when attached to the finger nail of a person or to the toe nails of the person.

As examples of the way in which chemilunminescent effects have previously been provided, I refer to such patents as U.S. Pat. No. 5,043,851 in the name of Kaplan, U.S. Pat. No. 4,076,645 in the name of Vega, U.S. Pat. No. 4,814,949 in the name of Elliot, Bay et al U.S. Pat. No. 5,121,302, and Elliott U.S. Pat. No. 4,814,949.

This is not an exhaustive list but illustrates the style of materials and chemicals that are currently known and can be used with this current invention including the chemicals and the catalysts.

This current invention relates to the application of any of these chemilunminescent techniques to the location as nail caps for fingers or toes of a wearer.

The way in which current techniques are used is to have two components that when they are brought together will cause the chemical reaction that provides the luminescence to commence and of course to continue for a period of time governed upon factors which relate to the condition of the chemicals used, their quantities and other external circumstances What this means however is that in order to commence the luminescence, there has to be an introduction of the one chemical composition into the other where these have been previously kept isolated.

One of the difficulties hitherto has been to ensure that the two chemicals can be kept sufficiently isolated but when necessary, be brought together in an efficient and effective way.

One method is to hold a first chemical composition in a frangible container in the cavity of the cap which can be fractured by external pressure between the upper and lower sides of the cavity.

In order to achieve this vulnerability to fracturing reliably, and also to ensure that there is sufficient impermeability in the materials being used to encapsulate the first chemical composition, glass has been used.

Glass is very effective for impermeability and is very vulnerable to fracture and is therefore an ideal material for this purpose except that once fractured, it can have sharp edges which, it an outside holding device is made to be used in situations where it will be extensively bent or used around the limbs or neck of people, then the characteristic of this outer material has to be such that it can safely contain possible piercing or fracture from internal glass fragments.

Currently, given the extent of possible bending that is required for a typical "light stick" it has not been possible to find a clear plastic that will provide sufficient resistance to piercing and accordingly, a plastic is still used but one that is not clear but is sufficiently translucent to allow a substantial proportion of light there through that still is a very much lesser proportion than that available of light from a chemilunminescent reaction.

One of the advantages then of providing an application where this is to be adhered to a surface which will provide substantial support, is that the wall of the casing can now be made so that at least its outer face can be of clear plastic chosen however to be able to contain any of the chemicals in the chemilunminescent process and of course with a cap, then it becomes possible to use internal frangible containers of glass which can therefore be readily fractured by pressure from outside against the inside surfaces and chemilunminescent effect then is significantly improved simply because it can now be viewed through clear plastics material without of course the underlying difficulty of danger to those that might be using the articles.

The invention is not intended to be limited to use of glass containers in its broader concept.

Figure 2:
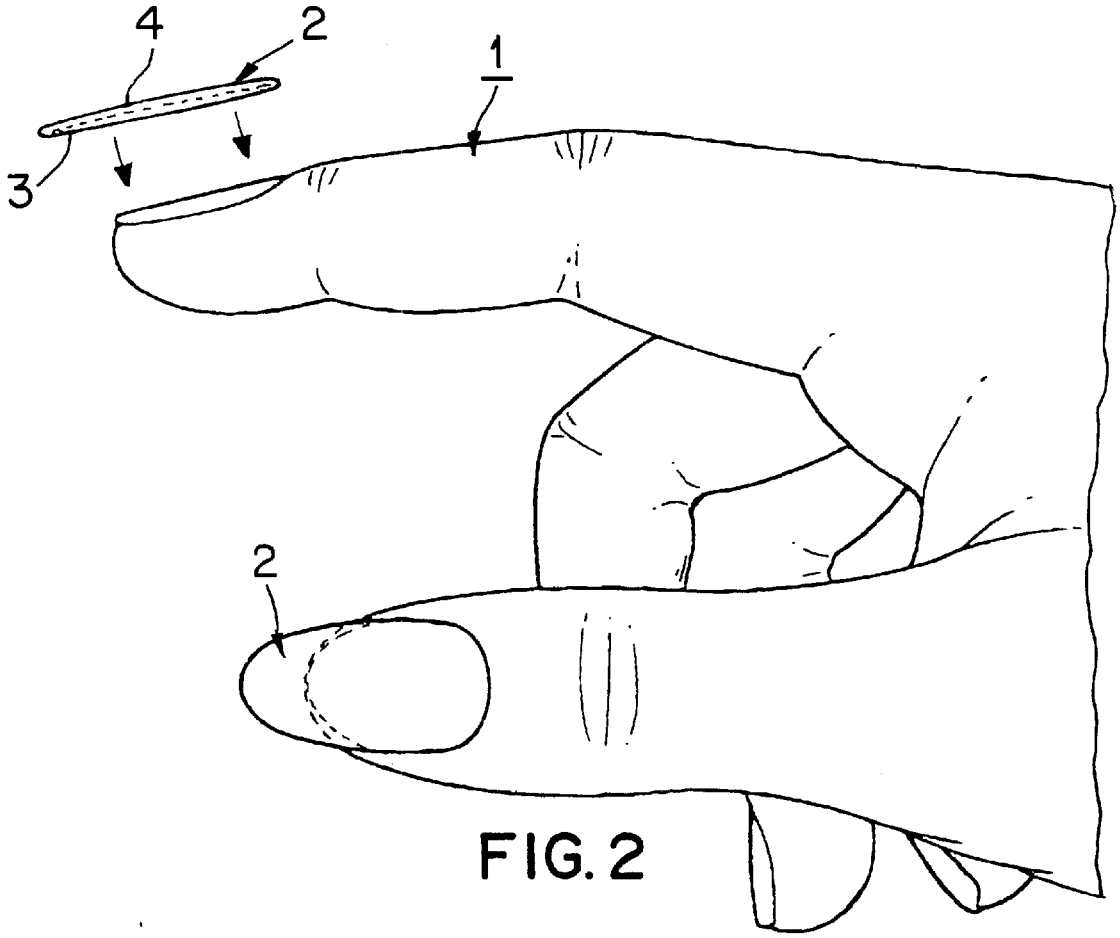
Figure 3:
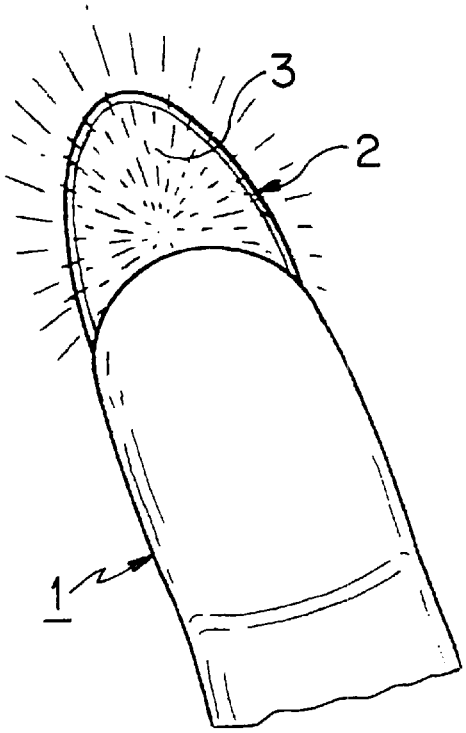
Figure 4:
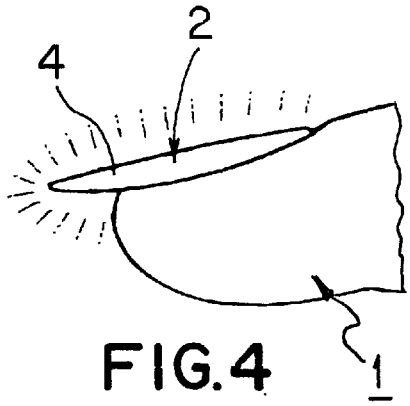
Figure 5:
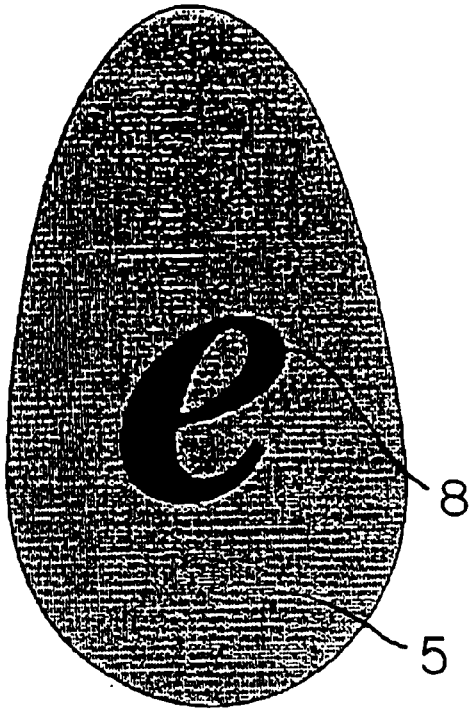
Figure 6:
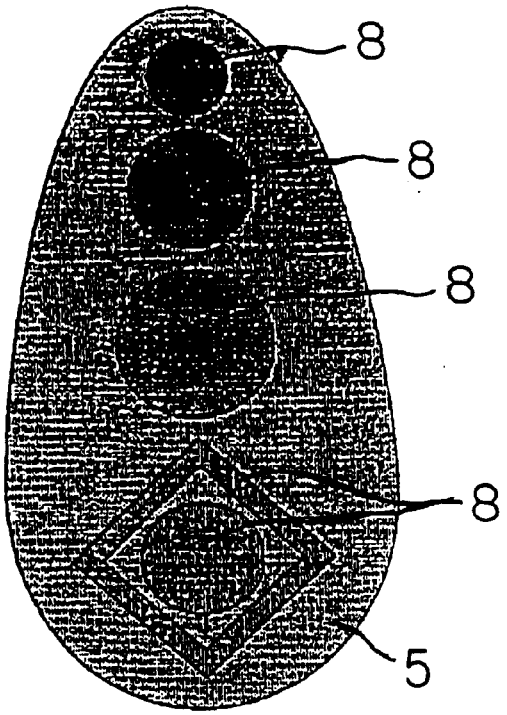
Figure 7:
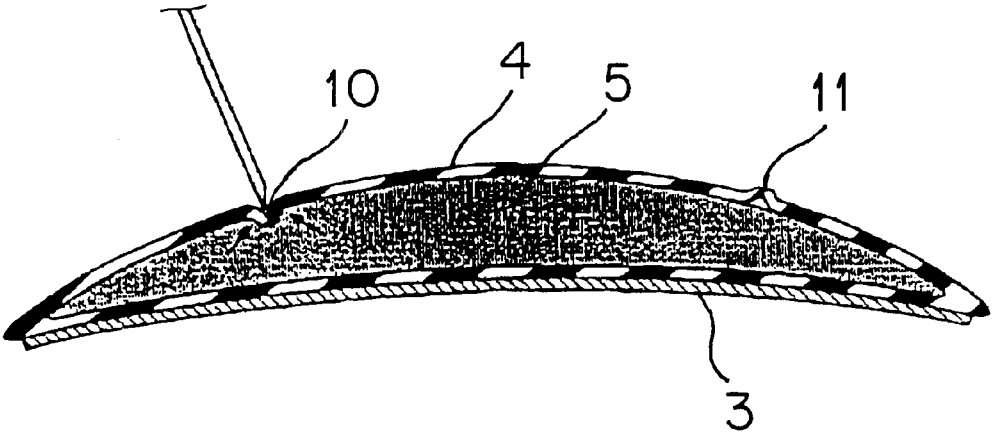
Figure 8:
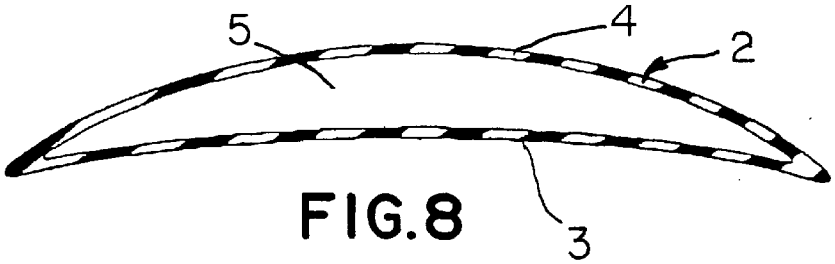
Figure 9:
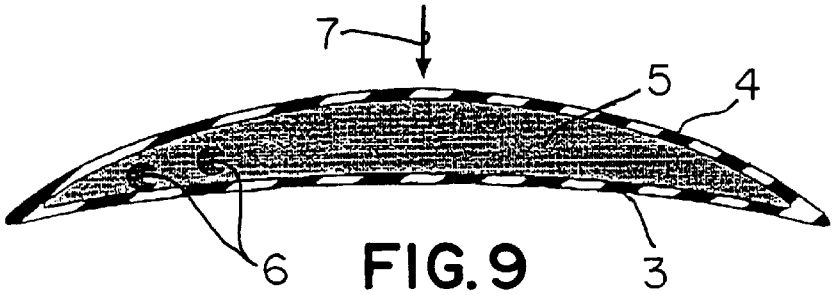
Figure 10:
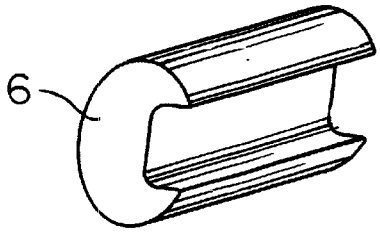
Figure 11:
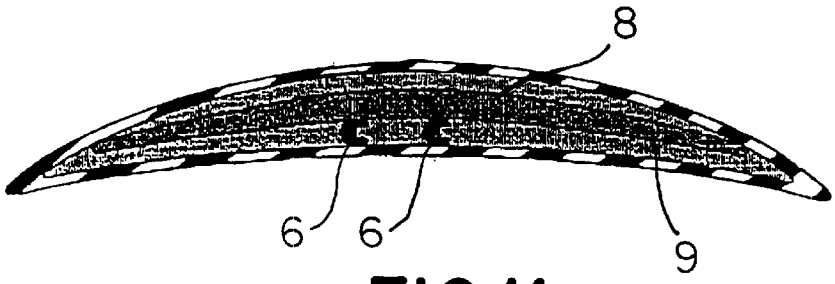
Figure 12:
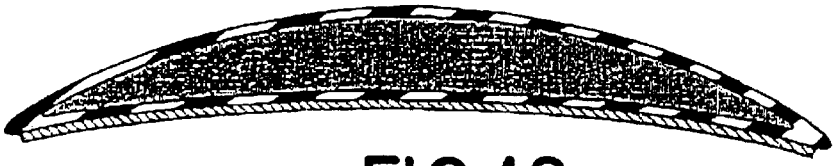
Figure 13:
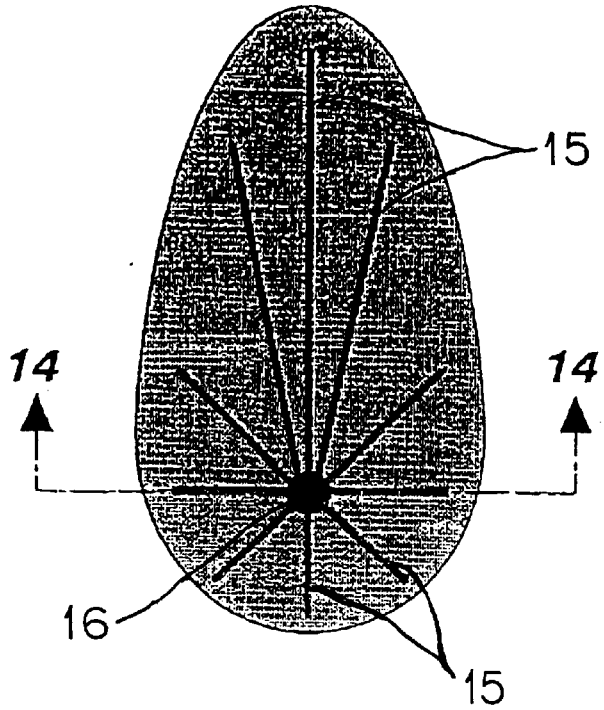
Figure 14:
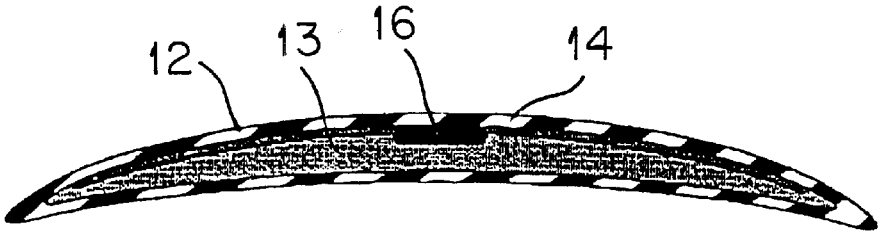
Figure 15:
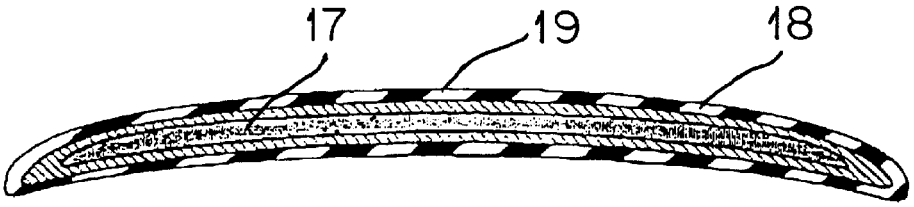

For a better understanding of this invention it will now be described with the assistance of drawings in which;

FIG. 1 illustrates is an enlarged view of the hand of a wearer having the finger caps in position attached to the finger nails in accord with embodiments of this invention, FIG. 2 is an enlarged view including for one finger a cap according to one embodiment being located on the finger and one about to be positioned on the fore finger of an intended wearer, FIG. 3 is a view beneath the finger, FIG. 4 is a view from the side, FIGS. 5 and 6 shows a cap according to a further embodiment including patterns within the chemilunminescent effect in this case there being shown the letter e and other patterns of various designs and these can also be of different colors and of different brightness by reason of pads holding different base chemicals to effect a different reaction to a catalyst, FIG. 7 is a cross-sectional view through a cap only having a wall defined by a fully transparent plastics material, FIG. 8 shows glass containers containing a catalyst to effect the chemilunminescent effect, where the remainder of the cap in this case is filed with a second chemical composition responsive to the chemical within the individual phials, FIG. 9 is a view of the cap with frangible glass containers which can be fractured under externally applied pressure to release catalyst into the body of the cap, FIG. 10 is a perspective view of an individual frangible glass container holding catalyst, FIG. 11 is a cross-sectional view of a pad with a central pad holding a second chemical composition in a way that will maintain a pattern visible through the cap when the chemilunminescent effect is made to occur, FIG. 12 is a cross sectional view of the cap with a two way adhesive material on an underneath side to assist for adhesion of the caps to the fingernails of a user, FIG. 13 is a plan view of a further embodiment showing an inner porous matrix with channels to assist in dissipation of any introduced catalyst to an embedded base chemical and a surrounding latex, FIG. 14 which is a cross section taken along the lines 14—14 in FIG. 13, FIG. 15 is another embodiment which shows an inner matrix coated with a latex surround and a further molded surround of acrylic uretane.

In FIGS. 1, 2, 3 and 4, there are fingers 1 to which are secured for each a cap 2 the shape of which is such that a lower wall 3 is shaped to have a complementary shape to a persons nails having accordingly a lowermost shape which is concave and of a shape and size whereby to match the shape of an upper surface of a nail of an intended wearer.

An upper side 4 has an uppermost shape which is convex and defines between itself and the lower side 3 an internal cavity 5. The sides are molded from a plastics material which is fully transparent so as to be able to transmit light therethrough, with minimal loss, from any chemilunminescent reaction in the cavity 5.

The shape and relative thinness of the sides 3 and 4 of the cap 2 provide a shape which is vulnerable to deflection under pressure in the middle of the cap 2 so that, when pressed together there will be some potential crushing between the sides 3 and 4 so that any frangible containers within the cavity can be crushed.

Accordingly, as shown particularly in FIGS. 7 through 12, the molded cap of plastics material 2 includes within its cavity 5 frangible glass containers 6 which are shaped so as to be able to be fractured by deliberate pressure in the direction 7. Glass is used because it is substantially impermeable so that volatile components of a catalyst will not accidentally weep over time through the container and therefore set off the chemilunminescent reaction before it is required.

There is located within the cavity 5 so as to be distributed across a full area available a base chemical which will effect the chemilunminescent reaction when having a catalyst added.

In a further embodiment as shown in FIG. 11, an additional pad as shown at 8 holds a composition such as in 9 so that there can be different visual patterns effected for instance where these are shown at FIGS. 5 & 6.

In a further embodiment see FIG. 7, the first chemical composition as a catalyst is inserted by way of a one way directional valve 10 inset within the wall 4 of the cap 2.

Furthermore, in FIG. 7 there is further shown at 11 a pressure relief valve to release excessive pressure that may result from any chemilunminescent reaction.

Now referring to FIGS. 13 and 14. there is shown an acrylic urethane outer shape at 12 that is molded by having the base matrix 13 with embedded base chemical dipped into monomer which is then polymerised by ultraviolet light to form a sealed container cast around and following the shape of the base matrix. To catalyse the base chemical, a needle with catalyst can be by inserted through the wall 14. To assist distribution of the catalyst there are a series of radiating channels 15 from a central location 16 which is the location at which the catalyst is to be introduced.

In a further embodiment as shown in FIG. 15, there is an inner matrix 17 which is coated in the first instance by a latex surround 18. This is achieved by dipping the base matrix into molten latex and then allowing this to dry and thereby set Then there is provided a further molded surround of acrylic urethane 19 which is achieved by dipping into molten monomer, the latex coated base matrix 20 which is then polymerised by being subjected to ultraviolet radiation.

The advantage of this last arrangement is that the latex will be able to be applied without being a gap filler and will also maintain a seal around the matrix after a needle has been inserted there through to inject catalyst. Further, the outer surface is provided by a material namely the acrylic urethane which is cosmetically acceptable while offering some pliability. Further, the latex allows for pressure containment.

Further, the method just described has the advantage of being able to be easily put into practice.

In a further embodiment there is provided a reflective sheet that is secured against the lower side of the cap above that area of the cap that will be directly above the nail of the wearer. In this way the remainder of the cap can provide a light output that will show through 360 degrees and above the nail 180 degrees but with reflected additional intensity.

The caps can be secured by any selected method but one of these is to use double sided tape.

The cap can be manufactured according to different techniques and as illustrative of these. the upper and lower walls can be separately molded by for instance injection moulding and snap locked together with as desired a seal joint connection. This can also be by way of thermoforming with ultrasonic or impulse welding joining the parts.

The matrix can be divided so that parts are of one colour as compared to others. This for instance can include black parts or contrasting colors or degrees of illumination.

The matrix can in the embodiments be generally within the range of thickness's of from 0.8 mm to 3.5 mm.

While there is shown an underneath arcuate concave shape which is chosen both in terms of size and degree of curvature to match a conventional shape of an intended wearers finger nail (or toe nail), these sizes and shapes will be changed of a range of peoples sizes and shapes (including whether the nail is the nail of a thumb or fingers or toes). The cap can extend both lengthwise and withwise in response to fashion or style demand The invention then can reside in a cap suitable for attachment to the nail of a person where the cap is comprised of a casing containing therein a combination of chemicals and means to effect the mixing of those within the casing to effect a chemilunminescent effect, and a transparency or translucency through at least a part of the casing to provide a visual exposure of any chemilunminescent effect.

The shape of the casing includes an outside shape that is adapted to engage against the nail of a person for attachment thereto.

In one embodiment there are means to effect introduction of a second chemical through a non return valve in the casing to effect thereby a mixing within the casing of the two necessary chemical materials to effect chemilunminescent.

In an alternative embodiment, there are within the cavity of the casing, two fragile containers which are glass holding in isolation until fractured, a first chemical composition such that when released, there will be effected into a remainder of the casing, a mixture affecting then for a period of time a chemilunminescent effect.

In a further embodiment, the caps can be separately attached to a supporting body which simulates the nail of a person or at least provides a support base upon which the cap is attached thereby providing protection against excessive bending of the casing and therefore vulnerability of fracture.

What is claimed is:

1. A nail cap adapted to be adhered to the finger of a wearer comprising a casing defining a cavity with an upper wall having at least a portion that will transmit light therethrough, the cavity having within it at least a first pad of porous material in the shape of a pre-determined pattern and embedded with a chemilunminescent chemical to which can be added a catalyst, wherein adding the catalyst to the chemilunminescent chemical effects a chemilunminescent pattern visible through the upper wall.

2. A nail cap having a casing defining a cavity with an upper wall having at least a portion that will transmit light therethrough, the cavity having within it a chemical to which can be added a catalyst to effect a chemilunminescent effect, the casing including means to allow introduction of a chemical catalyst through the casing to effect a chemilunminescent reaction within the casing that is visible through the upper wall.

3. A finger nail cap adapted to be adhered to the finger wearer comprising:

a casing having (1) an upper side having at least a portion though which light will shine, and (2) a lower side, the upper and lower sides defining a cavity;

at least one chemilunminescent chemical being within the cavity; and a frangible container in the cavity and holding a catalyst therein, the catalyst being isolated from the chemilunminescent chemical by the frangible container, wherein a chemilunminescent effect or pattern is achieved by breaking the frangible container to add the catalyst to the chemilunminescent chemical, the chemilunminescent effect or pattern being visible through the upper wall.

4. The finger nail cap of claim 3, wherein the lower side has a lowermost shape that is concave on its outer side and of a complementary shape and size to a nail of the wearer.

5. The finger nail cap of claim 3, wherein the finger nail cap is of a size such that it will extend past the length of a nail of a wearer when secured to the nail.

6. The finger nail cap of claim 3, wherein the casing is wholly formed of a molded transparent plastics material.

7. The nail cap of claim 3, wherein the frangible container is a glass capsule.

8. The nail cap of claim 3, wherein the frangible container is a substantially cylindrical capsule having a central axis and an indentation along the length thereof parallel to the central axis, wherein the frangible container has a crescent-shaped cross-section.

9. The finger nail cap of claim 1, wherein the lower side has a lowermost shape that is concave on its outer side and of a complementary shape and size to a nail of the wearer.

10. The finger nail cap of claim 1, wherein the finger nail cap is of a size such that it will extend past the length of a nail of a wearer when secured to the nail.

11. The finger nail cap of claim 1, wherein the casing is wholly formed of a molded transparent plastics material.

12. The finger nail cap of claim 1, wherein the chemilunminescent pattern has a color.

13. The finger nail cap of claim 1, further comprising a second pad of porous material in the shape of a pre-determined pattern disposed within the cavity and embedded with a chemilunminescent chemical to which can be added a catalyst, wherein adding the catalyst to the chemilunminescent chemical in the second pad effects a chemilunminescent pattern visible through the portion of the upper wall that will transmit light therethrough.

14. The finger nail cap of claim 13, wherein the chemilunminescent pattern of the first pad has a color that is different than the color of the chemilunminescent pattern of the second pad.

15. The finger nail cap of claim 13, wherein the chemilunminescent pattern of the first pad has a brightness that is different than the brightness of the chemilunminescent pattern of the second pad.

16. The finger nail cap of claim 2, wherein the lower side has a lowermost shape that is concave on its outer side and of a complementary shape and size to a nail of the wearer.

17. The finger nail cap of claim 2, wherein the finger nail cap is of a size such that it will extend past the length of a nail of a wearer when secured to the nail.

18. The finger nail cap of claim 2, wherein the casing is wholly formed of a molded transparent plastics material.

* * * * *

UNITED STATES PATENT AND TRADEMARK OFFICE

CERTIFICATE OF CORRECTION

PATENT NO. : 6,467,489 B1
DATED : October 22, 2002
INVENTOR(S) : Christiansen

It is certified that error appears in the above-identified patent and that said Letters Patent is hereby corrected as shown below:

Title page,
Item [73], Assignee, should read:
-- Nova Glo Pty International Ltd --

Signed and Sealed this

Thirteenth Day of July, 2004

JON W. DUDAS
*Acting Director of the United States Patent and Trademark Office*